United States Patent [19]

Bauer et al.

[11] Patent Number: 4,543,942

[45] Date of Patent: Oct. 1, 1985

[54] INSULATED FLUE ASSEMBLY

[75] Inventors: Gerald Bauer, Wilton, Wis.; Henry B. Swan, Burlington, Vt.

[73] Assignee: B&B Specialties Inc., Wilton, Wis.

[21] Appl. No.: 686,079

[22] Filed: Dec. 24, 1984

[51] Int. Cl.[4] ..... F23J 13/00

[52] U.S. Cl. ..... 126/314

[58] Field of Search ..... 126/314–319, 126/307 R, 312, 80; 52/219; 98/46, 58, 60

[56] References Cited

U.S. PATENT DOCUMENTS

| | | | |
|---|---|---|---|
| 1,321,675 | 11/1919 | Shurtleff | 126/314 |
| 1,744,269 | 1/1930 | Johnson | 126/314 |
| 2,159,539 | 5/1939 | Klein | 126/314 |
| 2,198,535 | 4/1940 | James | 126/314 |
| 3,136,309 | 6/1964 | Martz | 126/314 |

*Primary Examiner*—James C. Yeung

[57] ABSTRACT

An insulated flue protective assembly for insertion into a wall opening through which the chimney flue passes. The assembly comprises a square metal base unit having a center opening defined by a ring forming base flange. An insulated thimble is placed within the center opening defined by the ring, and is of a length so as to project to either side of the base unit. An elongated metal cover having at one end an annular flange forming a collar positionable about the ring of the base and which is adapted to receive an insulated sleeve, one end of which has mating contact with one end of the insulated thimble, thus insulating the chimney flue.

8 Claims, 5 Drawing Figures

INSULATED FLUE ASSEMBLY

SUMMARY OF THE INVENTION

This invention relates to a mounting assembly for insulated safety sleeves and thimbles for through-the-wall stovepipe installation. The insulated sleeve and thimble are constructed from a composition including cermaic fibers and a binder, thus it contains no asbestos or formaldehyde.

When wood or other combustible material is burned slowly it produces tar and other organic vapors which combine with expelled moisture to form creosote. The creosote vapors condense in a relatively cool chimney flue of a slow burning fire and as a result creosote residue accumulates on the flue lining. When ignited this creosote residue produces an extremely hostile hot fire.

It is the object of this invention to provide an assembly for positioning an insulated sleeve and thimble in a through-the-wall opening for the chimney stovepipe or exhaust flue.

Another object of the invention is to provide an insulated sleeve and thimble mounting for through-the-wall stovepipe insulation which permits easy removal of the stovepipe or flue for cleaning and inspection. The invention provides an assembly which is easily installed and requires no special tools.

Other objects will appear hereinafter and be readily apparent from the following detailed description of the invention.

BREIF DESCRIPTION OF THE DRAWINGS

Figure 1:
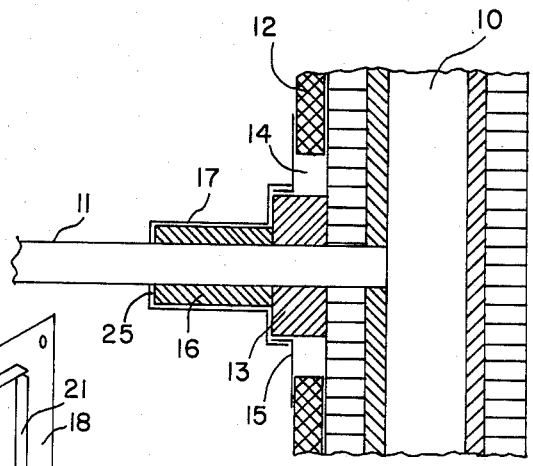
Figure 3:
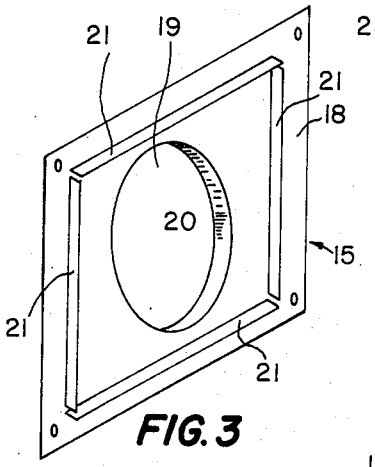
Figure 2:
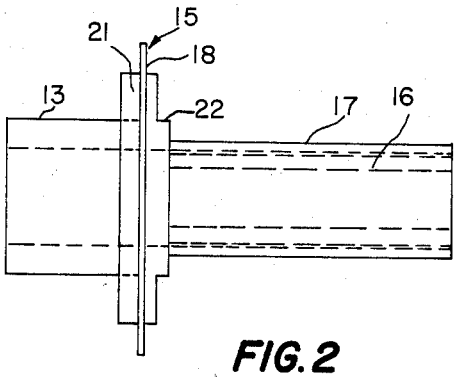
Figure 4:
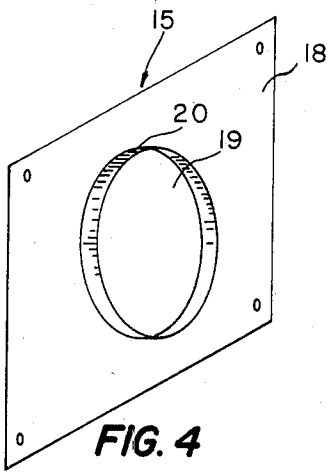
Figure 5:
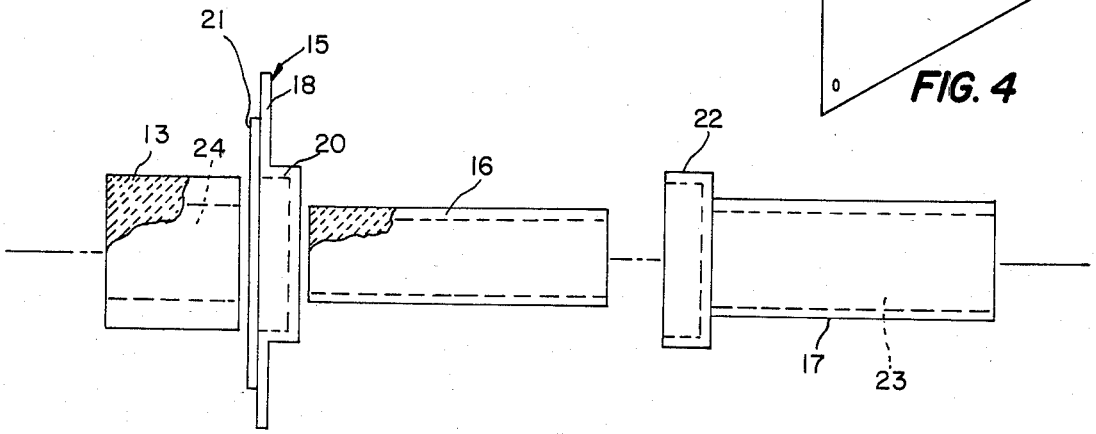

The invention will be best understood by reference to the accompanying drawings, showing the preferred construction and mode of assembly of the invention by which the stated objects thereof are achieved and in which;

FIG. 1 is a detailed side elevational view of a typical installation of the insulated through-the-wall stovepipe assembly of this invention, FIG. 2 is a side elevational view of the mounting for the insulated stovepipe sleeve and thimble, FIG. 3 is a perspective view of the rear of the metalic mounting base unit, FIG. 4 is a perspective view of the opposite face of the base mounting unit, and FIG. 5 is a side elevational view partially sectional view of the components of the invention in an exploded relationship.

GENERAL DESCRIPTION OF THE INVENTION

FIG. 1 illustrates a typical through-the-wall installation for the insulated stovepipe assembly of this invention. As such the chimney flue is indicated at 10. The stovepipe to be insulated is indicated at 11. The assembly of the invention is illustrated as being connected to the wall framing members 12. The insulated thimble 13 is shown as being positioned within the wall opening 14 and spaced from the framing 12. The thimble 13 is mounted within the base unit 15, which in turn is attached to the framing 12. A portion of the stovepipe 11 is journalled through an insulated sleeve 16 carried by a metal cover 17 which is in turn attached to the base unit 15.

As illustrated in FIG. 4 the base unit 15 comprises a square plate 18 having a center opening 19 defined on one face by perpendicularly extending annular flange 20 that in turn forms a receiving collar.

The opposite side of the base unit 15 as illustrated in FIG. 3 provides perpendicularly estending flanges 21 each of which extend at right angles with respect to each other and in a tangently relation with respect to the center opening 19. These flanges 21 proscribe the spacing limitations of the framing 12 with respect to the insulating unit.

The base unit 15 provides a housing for the insulated thimble 13. This thimble 13 is ringed shaped in formation and is of a length to extend into the collar of the base unit 15, as well as equal to the thickness of the wall framing 12. The mounting flanges 21 will space the thimble two inches from all framing members 12 which form a fifteen inch opening for the insulating assembly.

Adapted to cooperate with the mounted thimble 13 is the elongated insulated sleeve 16. To mount the sleeve 16 in an operative cooperating position with respect to the mounted thimble 13 there is provided a metalic pipe-like cover 17. As illustrated in FIG. 5 the cover 17 is provided at one end with an annular flange 22 having an outer diameter greater than the cover 17 and an inner diameter equal to the collar provided by the base unit 15. Thus as shown in FIGS. 1 and 2 the cover 17 has its flange 22 projected upon the collar of the base unit 15 with the insulated sleeve contained therein with its center core 23 in alignment with the center core 24 of the thimble 13. In such an assembly the insulated sleeve 16 has facial contact with the thimble 13 thus providing a continuous insulated stovepipe covering through and adjacent to the wall opening. It should be noted that the thimble is of a length so as to be in abutment with chimney wall and the inner end of the sleeve 16, so as to insure full insulation in these areas.

To retain the insulated sleeve 16 within the cover 17 the free end thereof is provided with a turned in anular flange 25 as shown.

From the foregoing there has been described a combination consisting of a thimble 13 and a thimble holder consisting of the base unit 15. Also included is a stovepipe insulated sleeve 16 and a sleeve holder consisting of the metal cover 17. The construction of the thimble holder and sleeve holder permits a defined connection therebetween by which a proper position is maintained between the thimble 13, the insulating sleeve 16 and the stovepipe 11.

It is desired that the thimble 13, as well as the sleeve 16 be composed from material other than asbestos or one containing formaldehyde, thus a composition of ceramics fillers, coated with a distributing agent such as starch, and blended with a silicone binder be employed, with the finished products being vacuum formed.

While we have illustrated and described the preferred form of construction and method for carrying out our invention, this is capable of variation and modification without departing from the spirit of the invention. We therefore do not wish to be limited to the various details set forth, but desire to avail ourselves of such obvious variations and modifications as come within the scope of the appended claims.

Having thus described our invention, what we claim as new and desire to protect by Letters Patent is:

1. An insulated stovepipe assembly for a through-the-wall stovepipe opening comprising, (a) a thimble holder having a center opening mounted in said through-the-wall stovepipe opening, (b) a circular ring like insulating thimble mounted in said center opening of said holder and encircling a portion of a stovepipe to be insulated, (c) a circular ring like stovepipe insulating sleeve journalled upon a protion of the stovepipe to be insulated, (d) a sleeve holder attached to one side of said thimble holder for positioning said thimble and said sleeve in axial alignment and facial abutment, and (e) means for attaching said sleeve holder to said thimble holder.

2. An insulated stovepipe assembly defined by claim 1 wherein said thimble holder comprises a square shaped base plate, one side of which is defined by an annular collar-forming flange, with said thimble mounted in said center opening and within said collar forming flange, and said sleeve holder mounted on said flange so as to axially align said thimble and said sleeve in facial abutment.

3. An insulated through-the-wall stovepipe assembly as defined by claim 1 wherein said sleeve holder comprises an elongated metalic pipe-like cover provided at one end with an enlarged annular flange having an internal diameter greater than said cover so as to receive therein a portion of said thimble holder for axially aligning and maintaining facial abutment between said thimble and said insulating sleeve when mounted upon the stovepipe.

4. An insulated through-the-wall stovepipe assembly as defined by claim 3 wherein said thimble holder comprises a square shaped base plate one side of which is defined by an annular collar forming flange with said collar forming flange having a diameter equal to the internal diameter of said annular flange provided at one end of said pipe-like cover and adapted to be positioned therein so as to axially align and maintain facial abutment between said thimble and said insulating sleeve when said sleeve holder is attached to said thimble holder.

5. An insulated through-the-wall stovepipe assembly as defined by claim 1 wherein said thimble holder provides means for positioning said holder in said through-the-wall opening with said thimble in spaced relation thereto.

6. An insulated through-the-wall stovepipe assembly as defined by claim 1 wherein said thimble and said insulating sleeve are formed from a composition consisting of ceramic fibers coated with a distributing agent and a binder whereby said thimble and said sleeve can be vacuum formed.

7. An insulated through-the-wall stovepipe assembly as defined by claim 4 wherein said thimble holder provides means for positioning said holder in said through-the-wall opening with said thimble in spaced relation thereto.

8. An insulated through-the-wall stovepipe assembly as defined by claim 4 wherein said thimble and said insulating sleeve are formed from a composition consisting of ceramic fibers coated with a distributing agent and a binder whereby said thimble and said sleeve can be vacuum formed.

* * * * *